US007690784B2

(12) United States Patent
Nishi et al.

(10) Patent No.: US 7,690,784 B2
(45) Date of Patent: Apr. 6, 2010

(54) PLATEN AND LIQUID EJECTING APPARATUS

(75) Inventors: Nobuyuki Nishi, Nagano (JP); Seiji Kawabata, Nagano (JP); Kazuhiro Hashii, Nagano (JP); Kazumasa Harada, Nagano (JP); Keiichiro Fukumasu, Nagano (JP); Hirohisa Adachi, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 647 days.

(21) Appl. No.: 11/524,283

(22) Filed: Sep. 21, 2006

(65) Prior Publication Data

US 2007/0064078 A1 Mar. 22, 2007

(30) Foreign Application Priority Data

Sep. 21, 2005 (JP) ..... P2005-273786

(51) Int. Cl.
*B41J 2/01* (2006.01)

(52) U.S. Cl. ..... 347/104; 347/31; 347/36

(58) Field of Classification Search ..... 347/104, 347/36, 31, 103, 34, 33
See application file for complete search history.

(56) References Cited

U.S. PATENT DOCUMENTS

| | | | |
|---|---|---|---|
| 6,910,757 | B2 | 6/2005 | Kanamitsu et al. |
| 7,204,577 | B2 | 4/2007 | Kanamitsu et al. |

FOREIGN PATENT DOCUMENTS

| | | | |
|---|---|---|---|
| CN | 1470388 | A | 1/2004 |
| JP | 2004-155109 | A | 6/2004 |
| JP | 2005-047239 | A | 2/2005 |

*Primary Examiner*—Manish S Shah
(74) *Attorney, Agent, or Firm*—Sughrue Mion, PLLC

(57) ABSTRACT

A plate-shaped main body, has a first face formed with a recess portion defined by a bottom face and side walls and a second face which is opposite to the first face. The plate-shaped main body is formed with a through hole connecting the bottom face and the second face. An overhanging portion, is provided on at least one of the side walls in the vicinity of the first face, and is located so as to at least partially hang over the through hole.

2 Claims, 9 Drawing Sheets

PLATEN AND LIQUID EJECTING APPARATUS

The disclosure of Japanese Patent Application No. 2005-273786 filed Sep. 21, 2005 including specification, drawings and claims is incorporated herein by reference in its entirety.

BACKGROUND OF THE INVENTION

The present invention relates to a platen and a liquid ejecting apparatus having the same.

The liquid ejecting apparatus referred to herein means not only a recording apparatus, such as a printer, a copying machine, or a facsimile machine, which uses an ink-jet type recording head and performs recording on a recording medium by ejecting ink from the recording head, but also an apparatus in which, instead of the ink, a liquid corresponding to its application is ejected from a liquid ejecting head corresponding to the ink-jet type recording head onto a target medium corresponding to the recording medium, so as to allow the liquid to attach to the target medium.

As the liquid ejecting heads include, it is possible to cite, in addition to the recording head, a colorant ejecting head used in the manufacture of a color filter such as a liquid-crystal display, an electrode material (electroconductive paste) ejecting head used in the formation of electrodes for an organic EL display and a field emission display (FED), a bioorganic compound ejecting head used in the manufacture of a biochip, a sample ejecting head as a precision pipette, and so on.

Hereafter, the ink jet printer as one example of the liquid ejecting apparatus will be described. In recent years, ink jet printers have come to be generally widespread whereby super-high image quality printing which is on par with that of silver halide photography is easily realizable at homes, just as is called home DPE. Among such ink jet printers, there are those which are configured to be able to execute so-called marginless printing in which printing is also effected at the four sides of printing sheet without margins so as to obtain an output result equivalent to that of silver halide photography.

As the construction of such an ink jet printer, a generally adopted construction is such that recessed portions are provided in a platen provided so as to oppose the ink jet recording head and defining the distance between the printing sheet and the ink jet recording head, ink is ejected to regions offset from sheet end portions, and the ink ejected to the offset regions is discarded to the aforementioned recessed portions.

In addition, an ink absorbing material for absorbing the ink is provided in the recessed portions to prevent as practically as possible the floating of an ink mist due to the atomization of the ink which is discarded, and hole portions for ejecting the absorbed ink to below are formed in its bottom. Further, a construction is adopted in which the ink absorbed by the ink absorbing material is allowed to drop from the hole portions to a waste liquid collecting means (e.g., a waste liquid tray) provided below the platen (e.g., refer to Japanese Patent Publication No. 2002-86757A).

When the carriage with the recording head mounted thereon starts to move from a standstill state, there are cases where, in conjunction with this operation, a negative pressure is temporarily applied to the place where the cartridge was at a standstill.

If the above-described hole portions for ejecting the ink to outside are provided in the bottoms of the recessed portions formed in the platen, there occurs the flow of air which penetrates the platen upwardly from below owing to the occurrence of the aforementioned negative pressure. Due to such flow of air, the ink mist floating over the platen is scattered more extensively, so that there is a possibility that the interior of the apparatus is fouled, exerting an adverse effect on the constituent elements.

SUMMARY OF THE INVENTION

It is therefore an object of the invention to provide a platen and a liquid ejecting apparatus to prevent the ink mist from being scattered extensively due to the above-described flow of air occurring in conjunction with the moving operation of the carriage and from thereby fouling the interior of the apparatus, or to alleviate the extent of the fouling.

In order to achieve the above object, according to the invention, there is provided a platen comprising: a plate-shaped main body, having a first face formed with a recess portion defined by a bottom face and side walls and a second face which is opposite to the first face, and the plate-shaped main body formed with a through hole connecting the bottom face and the second face; and an overhanging portion, provided on at least one of the side walls in the vicinity of the first face, and located so as to at least partially hang over the through hole. With this configuration, even if there occurs the flow of air which is directed upwardly from below the platen through the through hole, the flow is hampered by the overhanging portions. Accordingly, it is possible to prevent the ink mist floating over the platen from being scattered more extensively, or alleviate the extent thereof. Namely, it is possible to prevent the fouling of the interior of the apparatus and the exerting of an adverse effect on the constituent elements, or alleviate the extent thereof.

The recess portion and the through hole may define a crank shaped channel connecting the first face and the second face. With this configuration, even if there occurs the flow of air which is directed upwardly from below the platen through the hole portions, the flow is hampered. Accordingly, it is possible to prevent the ink mist floating over the platen from being scattered more extensively, or alleviate the extent thereof. Namely, it is possible to prevent the fouling of the interior of the apparatus and the exerting of an adverse effect on the constituent elements, or alleviate the extent thereof.

The through hole may be formed on an entire peripheral edge of the bottom face. With this configuration, the ink is difficult to stay in the bottom, i.e., the ink can be ejected smoothly to outside the platen.

The recess portion may be adapted to accommodate an ink absorbing member; and the overhanging portion may be adapted to retain the ink absorbing member accommodated in the recess portion. With this configuration, the ink absorbing member can be retained on the recess portion inexpensively.

According to the invention, there is also provided a liquid ejecting apparatus comprising: a liquid ejecting head, operable to eject liquid toward a target medium; and the platen as described above, which is disposed so as to oppose the liquid ejecting head and is adapted to support the target medium so as to define a gap between the target medium and the liquid ejecting head. With this configuration, the liquid ejecting apparatus is able to obtain operational effects similar to above-described operational effects.

BRIEF DESCRIPTION OF THE DRAWINGS

The above objects and advantages of the present invention will become more apparent by describing in detail preferred exemplary embodiment thereof with reference to the accompanying drawings, wherein.

DETAILED DESCRIPTION OF THE EMBODIMENTS

Figure 1:
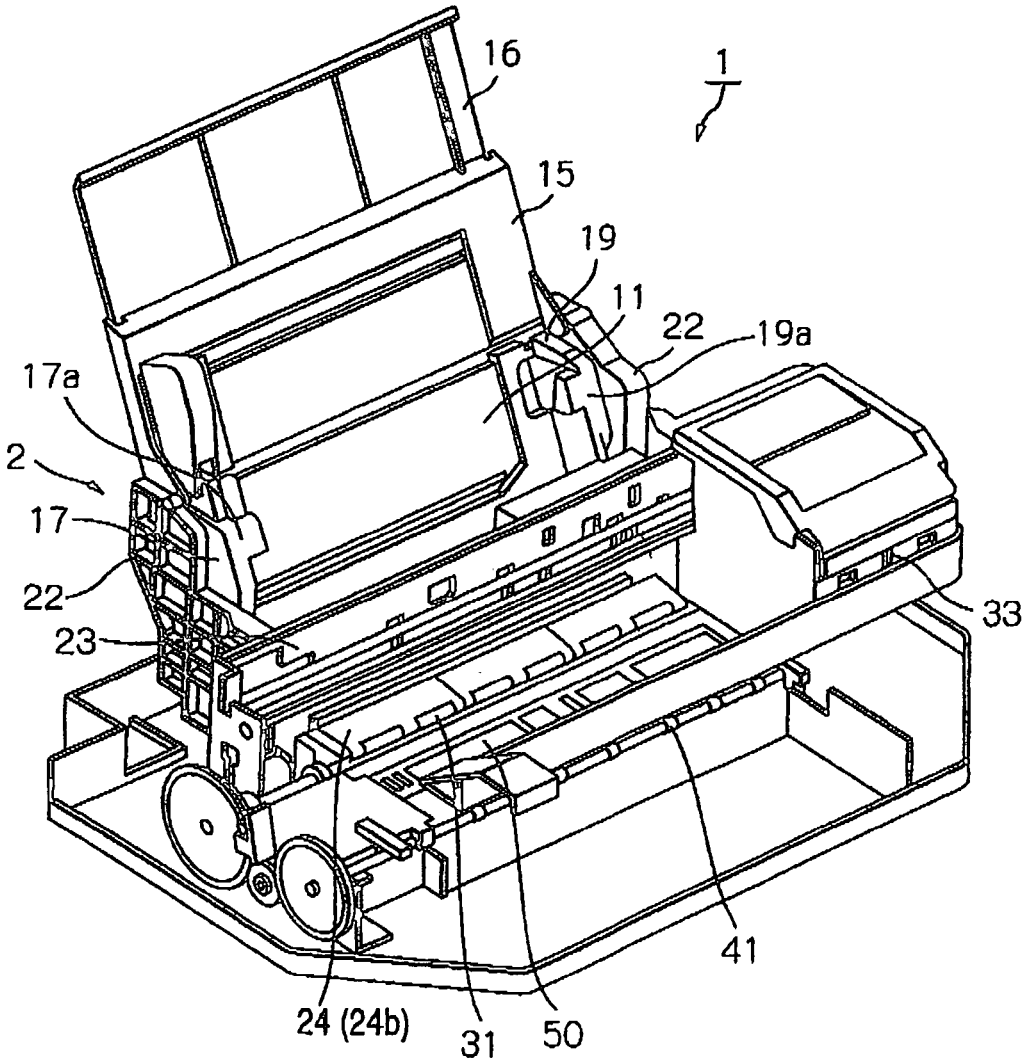
FIG. 1 is a perspective view of an apparatus body of a printer in accordance with the invention.

Embodiments of the invention will be described in detail with reference to the accompanying drawings. Hereafter, referring to FIGS. 1 and 2, a description will be given of the outline of an ink jet printer hereafter referred to as the "printer") 1 as one example of a liquid ejecting apparatus in accordance with the invention. It should be noted that in the following description the rightward direction side (front side of the printer) in FIG. 2 will be referred to as the "downstream side" of a sheet transporting (feeding) route, while the leftward direction side (rear side of the printer) will be referred to as the "downstream side" thereof.

The printer 1 has a feeding device 2 whereby recording sheet (cut sheet in the main; hereafter referred to as the "sheet P") as one example of the "recording medium" or the "target medium" can be set in an inclined posture, and the sheet P is fed from the feeding device 2 toward a recording medium transporting means 4. The fed sheet P is transported to a recording means 3 on the downstream side by the recording medium transporting means 4 to execute recording. The sheet P on which recording has been performed by the recording means 3 is ejected to forwardly of the apparatus by a recording media ejecting means 5 on the downstream side.

Hereafter, a more detailed description will be given of the constituent elements of the printer 1 on the sheet transporting route. The feeding device 2 is comprised of a hopper 11, a feed roller 12, a retard roller 13, a return lever 14, a sheet support 15, an auxiliary support 16, a movable edge guide 17, and a fixed edge guide 19.

The hopper 11 consists of a plate-like member and is provided swingably about a swinging fulcrum (not shown) at its upper portion. As the hopper 11 is swung, it is changed over between a pressure contact posture in which the sheet P supported on the hopper 11 in the inclined posture is brought into pressure contact with the feed roller 12 and a spaced-apart posture in which the sheet P is spaced apart from the feed roller 12. The feed roller 12 is formed in a substantially D-shape in a side view, and is controlled such that the sheet P at the uppermost position is fed to the downstream side by its circular arc portion, and such that while the sheet P is being transported by the recording medium transporting means 4 after the feeding of the sheet P, its flat portion opposes the sheet P so as not to apply a transporting load, as shown in the drawing.

The retard roller 13, which has its outer periphery formed of an elastic material, is provided so as to be capable of being brought into pressure contact with the circular arc portion of the feed roller 12, and is provided in a state in which a predetermined rotational resistance (torque) is applied thereto. In a case where the multiple feeding of the sheet P does not occur and only one sheet is being fed, a torque exceeding the aforementioned rotational resistance is applied to the retard roller 13, so that the retard roller 13 is drivenly rotated (clockwise in FIG. 2) with respect to the feed roller 13. Meanwhile, in a case where a plurality of sheets of the sheet P are present between the first ribs 12 and the retard roller 13, since the coefficient of friction between the sheets of sheet is lower than the coefficient of function between the sheet P and the retard roller 13, the torque exceeding the aforementioned rotational resistance is not applied to the retard roller 13, so that the retard roller 13 doe not rotate and remains at a standstill. Accordingly, the subsequent sheets of the sheet P which tend to be fed overlapped by accompanying the uppermost sheet P to be fed do not advance from the retard roller 13 toward the downstream side, thereby preventing the multiple feeding.

The return lever 14 is provided swingably in a side view of the feeding route of the sheet P. As the return lever 14 is swung, the return lever 14 exhibits the action of returning onto the hopper 11 the subsequent sheets of the sheet P which tended to be fed overlapped.

The sheet support 15 and the auxiliary support member 16 (FIG. 1) end the sheet supporting surface in the hopper 11 toward the rear end of the sheet P to support the rear end of the sheet P.

The movable edge guide 17 and the fixed edge guide 19 are provided so as to oppose each other in the hopper 11, and abut against the edges of the sheet P to rests the positions of the edges. The movable edge guide 17 is provided displaceably (slidably) in the widthwise direction of the sheet P in the hopper 11, with the result that the movable edge guide 17 is displaceable to an appropriate position fitted to the widthwise dimension of the sheet P.

It should be noted that reference numerals 17*a* and 19*a* denote restricting portions which are respectively formed on the movable edge guide 17 and the fixed edge guide 19. These restricting portions 17*a* and 19*a* function to guide the sheet P at the time of setting the sheet P, and restrict a maximum number of sheets (an allowable maximum number of sheets) of the sheet P which are supported on the hopper 11 (set in the feeding device 2).

Next, the following are provided between the feeding device 2 and the recording medium transporting means 4: sheet detecting means (not shown) for detecting the passage of the sheet P; a guide roller 26 which forms the posture of the sheet P being fed and prevents the contact of the sheet P with the feed roller 12 so as to alleviate the transport load; and a rear portion guiding member 57 for guiding to the recording medium transporting means 4 the sheet P being fed.

The recording medium transporting means 4 provided on the downstream side of the feeding device 2 is comprised of a transport drive roller 30 which is rotatively driven by a motor and transport driven rollers 31 which are drivenly rotated by coming into pressure contact with the transport drive roller 30. The transport drive roller 30 is formed by having an adherent layer in which abrasion resistant particles are dispersed substantially uniformly on an outer peripheral face of a metallic shaft extending in the widthwise direction of the sheet. The transport driven rollers 31 has its outer peripheral surface formed of a low friction material such as an elastomer, and are arranged in the axial direction of the transport drive roller 30.

More specifically, in this embodiment, two transport driven rollers 31 are axially supported freely rotatably at a downstream end portion of each of three main body portions 24*b* constituting an upper sheet guide 24. As the three main body portions 24*b* are provided in the widthwise direction of the sheet, as shown in FIG. 1, the three main body portions 24*b* as a whole constitute the upper sheet guide 24. As a shaft 24*a* of the upper sheet guide 24 is axially supported by a main frame 23, the upper sheet guide 24 is provided swingably about the shaft 24*a* in a side view of the sheet feeding route, and is urged by a coil spring 25 in a direction in which the transport driven rollers 31 are brought into pressure contact with the transport drive roller 30.

The sheet P which reached the recording medium transporting means 4 is transported to the recording means 3 on the downstream side as the transport drive roller 30 rotates in a state in which the sheet P is nipped by the transport drive roller 30 and the transport driven rollers 31.

The recording means 3 is comprised of an ink jet recording head (hereafter, the "recording head") 36 and a lower sheet guide 50 (platen 56) provided in such a manner as to oppose the recording head 36. The recording head 36 is provided on a bottom portion of a carriage 33, and the carriage 33 is driven so as to reciprocate in the main scanning direction by an unillustrated drive motor while being guided by a carriage guide shaft 34 extending in the main scanning direction. Further, ink cartridges 35 which are respectively independent for a plurality of colors are installed on the carriage 33 to supply ink to the recording head 36.

On the lower sheet guide 50 (platen 56) which defines the distance between the sheet P and the recording head 36, first ribs 51, second ribs 52, and third ribs 53 are formed on its surface opposing the recording head 36, and grooves 54 and 55 and grooves A to G (see FIG. 5) serving as "recessed portions" for discarding the ink are formed therein. It should be noted that a detailed description will be given later of the construction of the lower sheet guide 60.

Subsequently, an auxiliary roller 43 and the recording medium ejecting means 5 are provided on the downstream side of the recording head 36. The auxiliary roller 43 is provided so as to be drivenly rotated in contact with the recording surface of the sheet P on the sheet transporting route ranging from the region where the recording head 36 and the platen 56 oppose each other to the recording medium ejecting means 5. Hence, the auxiliary roller 43 functions to maintain the distance between the sheet P and the recording head 36 to a fixed distance by preventing the lifting up of the sheet P from the platen 56. The recording medium ejecting means 5 is comprised of eject drive rollers 41 which are rotatively driven by an unillustrated motor and eject driven rollers 42 which are drivenly rotated in contact with the eject drive rollers 41. In this embodiment, the eject drive rollers 41 are constituted by rubber rollers and are arranged in the anal direction of a rotating shaft 40 which is rotatively driven (see FIG. 3).

The eject driven rollers 42 are constituted by toothed rollers having a plurality of teeth on their outer peripheries, and are provided on a sheet eject frame assembly 45 having an elongated shape in the main scaring direction so as to respectively correspond to the eject drive rollers 41. The sheet P on which recording has been performed by the recording means 3 is ejected toward the front side (unillustrated stacker) of the apparatus as the eject drive rollers 41 are rotatively driven in a state in which the sheet P is nipped by the eject drive rollers 41 and the eject driven rollers 42.

Figure 3:
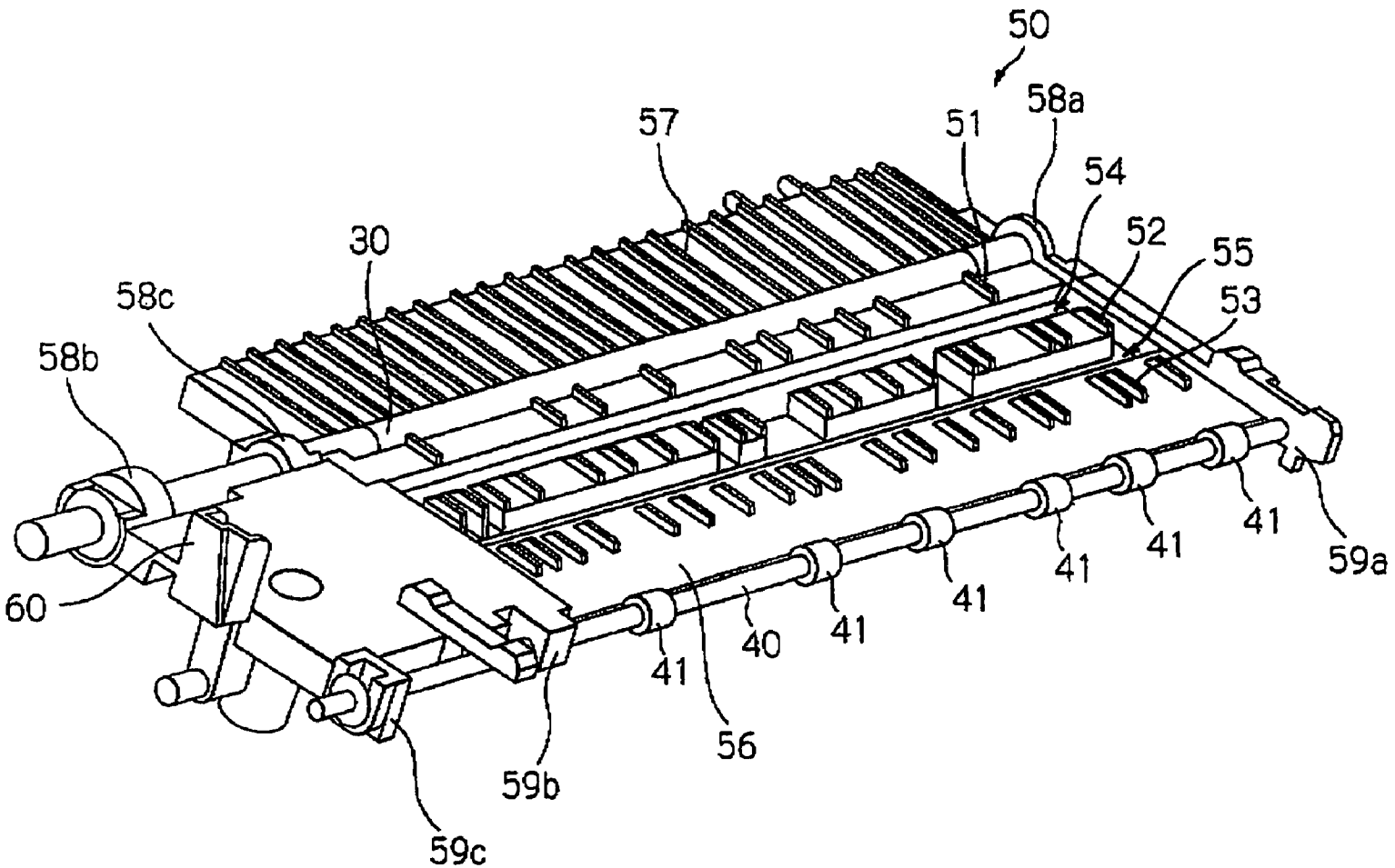
FIG. 3 is a perspective view of a lower sheet guide and constituent elements in the vicinity of the same.
Figure 4:
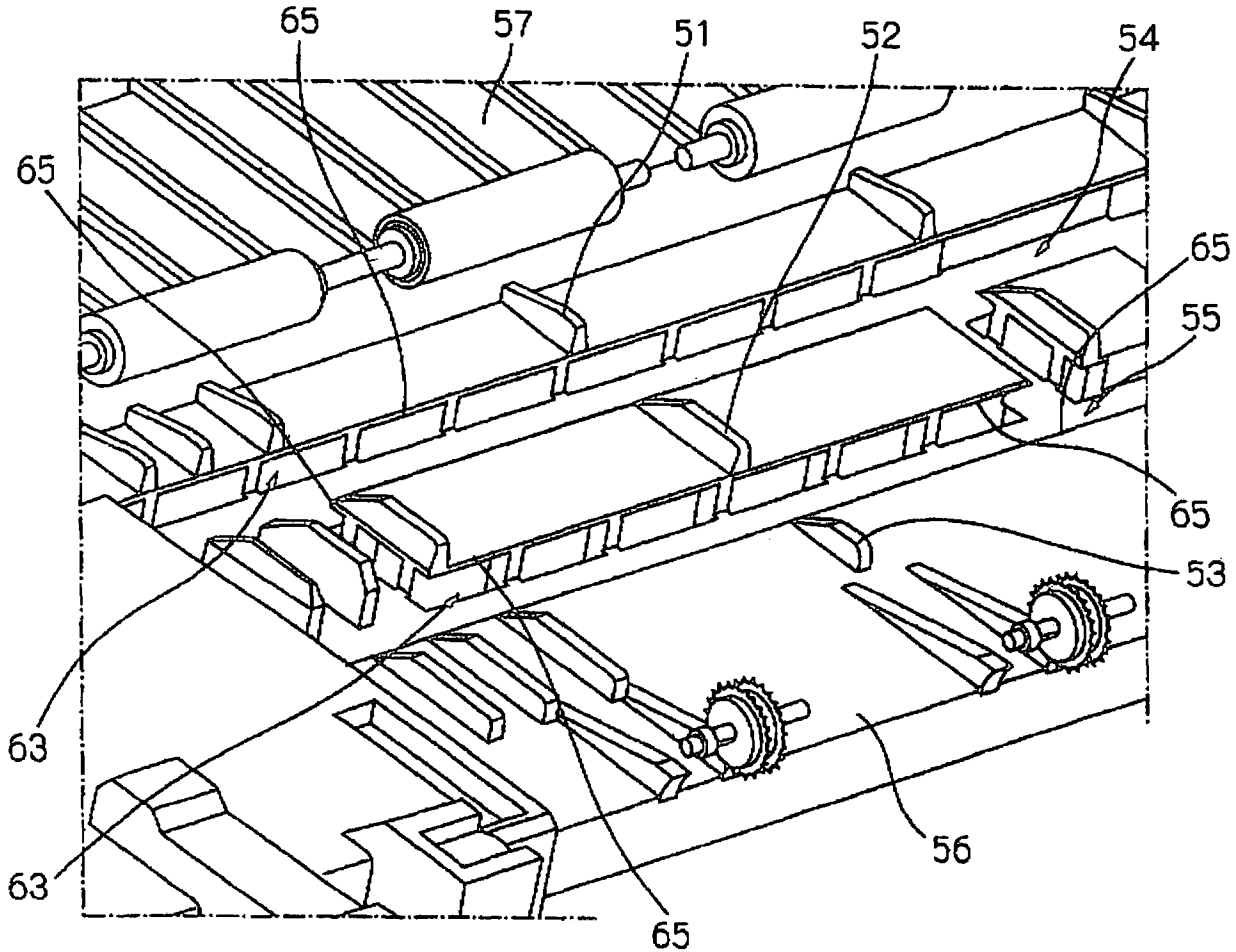
FIG. 4 is an enlarged perspective view of a platen in the printer.
Figure 5:
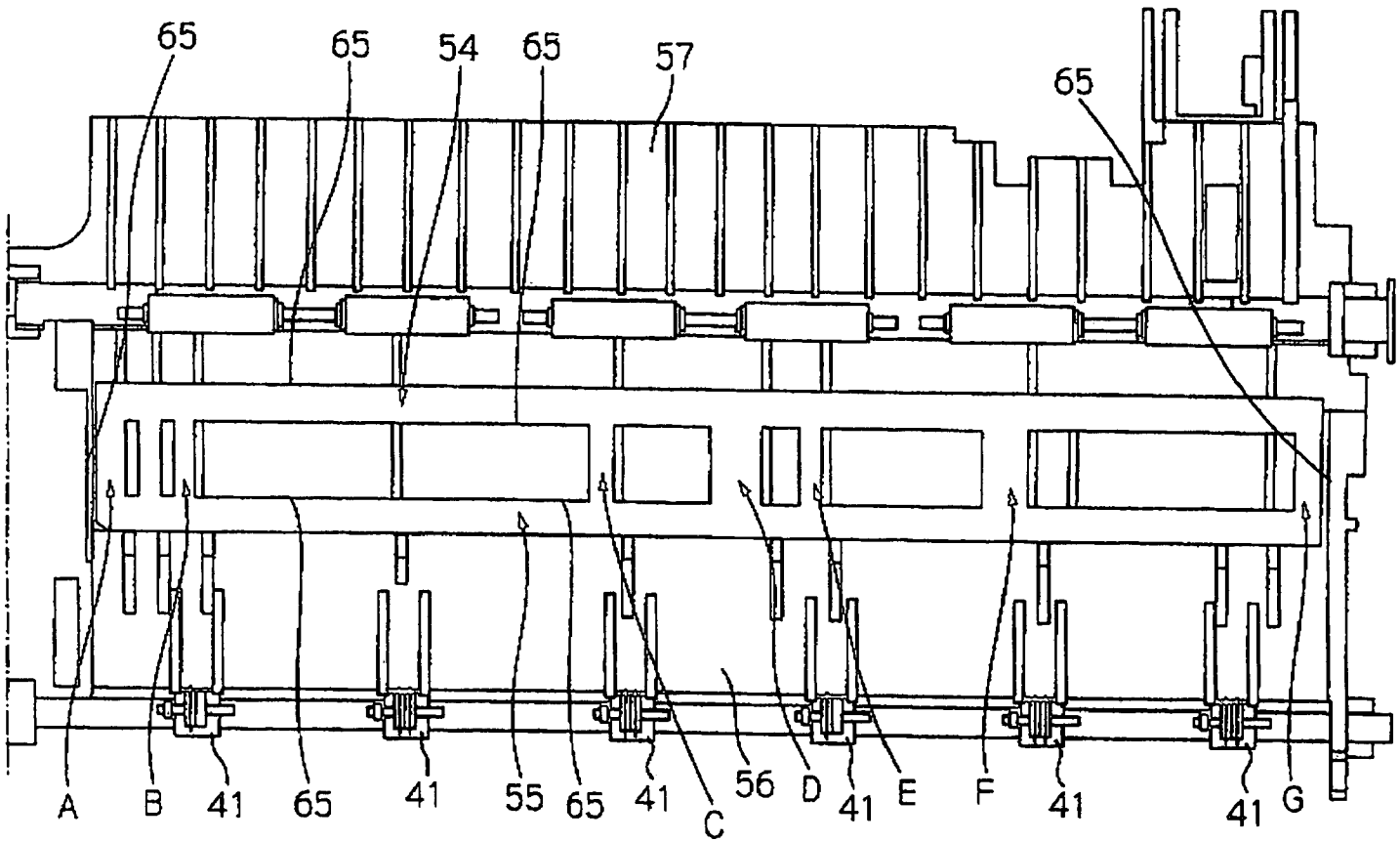
FIG. 5 is a plan view of the lower sheet guide.
Figure 6:
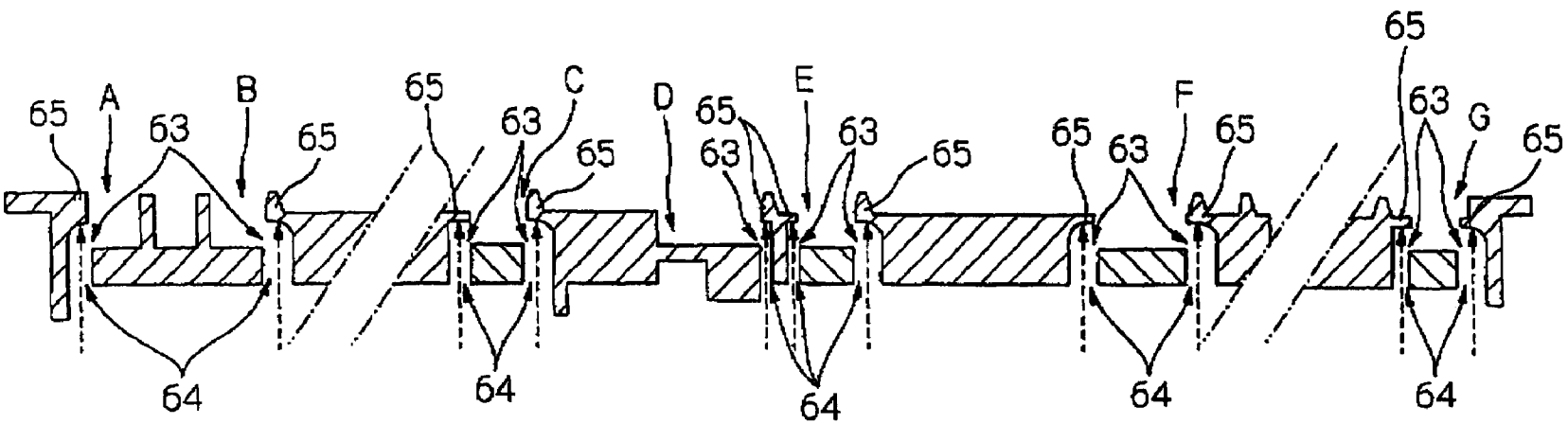
FIG. 6 is a cross-sectional view, taken along the main scanning direction, of the platen.
Figure 7:
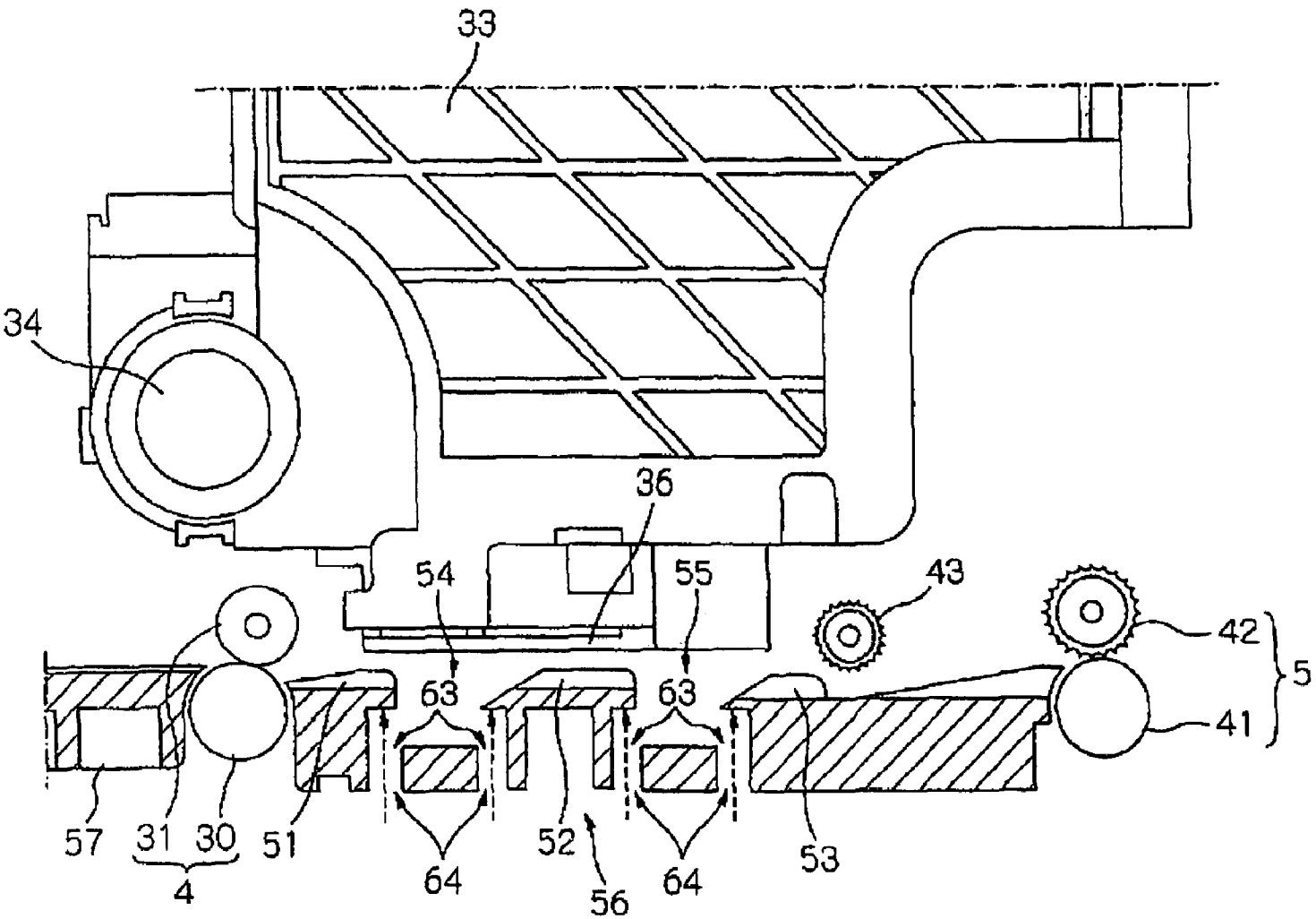
FIG. 7 is a cross-sectional view, taken along the sub scanning direction, of the platen.
Figure 8:
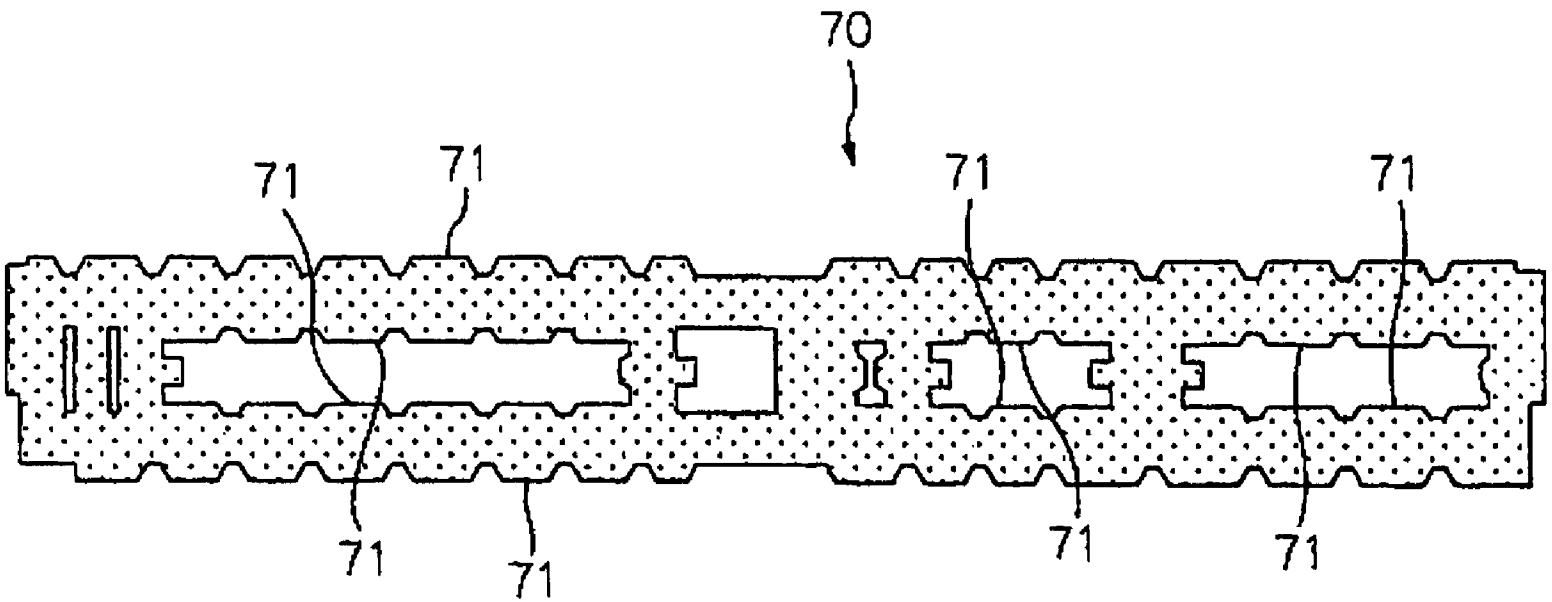
FIG. 8 is a plan view of an ink absorbing material.

The above-described is the outline of the printer 1, and a detailed description will be given of the lower sheet guide 50 with reference to FIGS. 3 to 8. Here, FIG. 3 is an external perspective view of the lower sheet guide 50 and constituent elements in its vicinities. FIG. 4 is a partial enlarged perspective view of the lower sheet guide 50 (platen 56). FIG. 5 is a plan view of the lower sheet guide 50. FIG. 6 is a cross-sectional view, taken along the main scanning direction, of the lower sheet guide 50 (platen 56). FIG. 7 is a cross-sectional view, taken along the sub scanning direction, of the lower sheet guide 50 (platen 56). FIG. 8 is a plan view of an ink absorbing material 70.

As shown in FIG. 3, the lower sheet guide 50, which is integrally molded from a resin material, has as its principal body the platen 56 on the downstream side of the transport drive roller 30, and is integrally comprised mainly of the rear portion guiding member 57 on the upstream side of the transport drive roller 30, bearing portions 58*a*, 58*b*, and 58*c* for axially supporting the transport drive roller 30, bearing portions 59*a*, 59*b*, and 59*c* for anally supporting the rotating shaft 40 of the eject drive rollers 41, and a rotation-detecting-means attaching portion 60 for attaching a rotation detecting means (not shown) for detecting the amount of rotation of the transport drive roller 30.

As has been described with reference to FIG. 2, the platen 56 is provided at a position opposing the recording head 36, defines a gap between the sheet P and the recording head 36, and guides the sheet P to the downstream side. The rear portion guiding member 57 guides to the transport drive roller 30 the sheet P which is fed from the feeding device 2.

As shown in FIGS. 3 to 5, on the surface of the platen 56 opposing the recording head 36, the first ribs 51 extending in the sub scanning direction are provided in the vicinity of the downstream side of the transport drive roller 30; the second ribs 52 extending in the sub sang direction are provided on the downstream side of the first ribs 51 with the groove 54 located therebetween; and the third ribs 53 are provided on the downstream side of the second ribs 52 with the groove 55 located therebetween. The first ribs 51, the second ribs 52, and the third ribs 53 are respectively provided at appropriate intervals in the main scanning direction, support the sheet P from below, and define the gap between the sheet P and the recording head 36. It should be noted that the second ribs 52 are located in a range where ink ejecting nozzles (not shown) in the recording head 36 are formed, while the first ribs 51 and the third ribs 53 are located outside the range where the ink ejecting nozzles are formed.

As described above, the groove 54 extending in the main scanning direction is formed between the first ribs 51 and the second ribs 52, and the groove 55 extending in the main scanning direction is similarly formed between the second ribs 52 and the third ribs 53. In addition, the grooves A to G are formed between the first ribs 51 and the third ribs 53 at portions corresponding to side end positions of the sheet P of predetermined sizes.

The grooves 54 and 55 are for respectively discarding ink droplets which are ejected to portions offset from a trailing end and a leading end of the sheet P. Namely, when the leading end of the sheet P has reached the upper portion of the groove 55, ink droplets are ejected to the leading end of the sheet P and a portion offset from that leading end, whereby marginless recording is executed at the leading end of the sheet P, and the ink droplets offset from the leading end of the sheet P are discarded to the groove 55. Also, when the trailing end of the sheet P has reached the upper portion of the groove 54, ink droplets are ejected to the trailing end of the sheet P and a portion offset from that trailing end, whereby marginless recording is executed at the trailing end of the sheet P, and the ink droplets offset from the trailing end of the sheet P are discarded to the groove 54.

Also, the grooves A to G are for discarding ink droplets which are ejected to portions offset from side ends of the sheet P. Specifically, the groove G is provided at a position where a side end on one side of the sheet P of all sizes passes, while the grooves A to F are respectively provided at positions where side ends on the other sides of the sheet P of the respective sizes pass. As ink droplets are ejected to portions offset from both side ends of the sheet P on which recording is performed, marginless recording is executed at the side ends of the sheet P, and the ink droplets are discarded to the grooves provided at positions corresponding to the sheet width.

Figure 2:
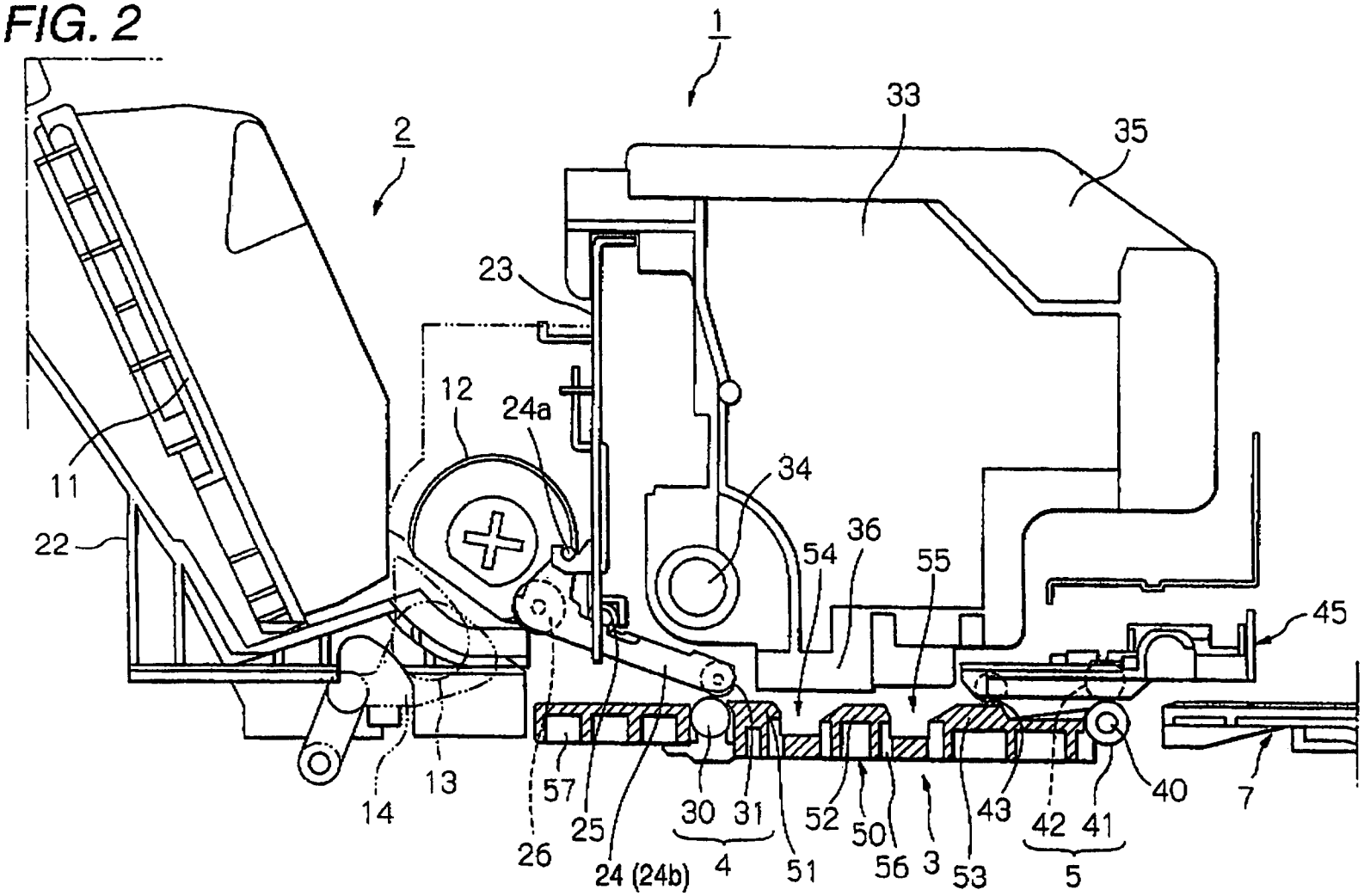
FIG. 2 is a cross-sectional view of the printer.

As also shown in FIG. 2, the rear portion guiding member 57 is located in the vicinity of the upstream side of the transport drive roller 30, and has on its surface a plurality of ribs extending in the sub scanning direction at appropriate intervals in the main scanning direction so as to guide the sheet P smoothly to the transport drive roller 30.

Next, as shown in FIG. 3, the transport drive roller 30 located between the rear portion guiding member 57 and the platen 56 is anally supported by the bearing portions 58*a*, 58*b*, and 58*c* hereafter, collectively referred to as the "bearing portions 58," as required) which are integrally formed of a resin material together with the rear portion guiding member 57 and the platen 56. Also, the rotating shaft 40 of the eject drive rollers 41 located on the downstream side of the platen 56 are axially supported by the bearing portions 59*a*, 59*b*, and 59*c* (hereafter, collectively referred to as the "bearing portions 59," as required) which are integrally formed of the material together with the rear portion guiding member 57 and the platen 56.

Accordingly, since the constituent elements of the rear portion guiding member 57, the bearing portions 58, and the bearing portions 59 are integrally provided on the platen 56, it is possible to reduce the number of steps of assembly as compared with the construction in which the constituent elements are separately formed and are subsequently assembled. At the same time, it becomes possible to minimize variations in the manufacture of the constituent elements, assembly errors at the time of assembly, and so on. In consequence, it is possible to form a sheet transport route of more uniform quality, with the result that individual differences between apparatuses decrease, thereby making it possible to realize further stabilization of the recording quality. In addition, it becomes possible to prevent a decline ion the sheet transporting accuracy, and when marginless printing is executed, it becomes possible to minimize the amount of ink discarded by being offset from the end portions of the sheet P. Namely, it becomes possible to appropriately execute marginless printing in which the amount of image data discarded is extremely small.

In addition, since the bearing portions 58 for pivotally supporting the transport drive roller 30 are provided at both shaft end positions (bearing portions 58*a* and 58*c*) of the transport drive roller 30 and one position (bearing portion 58*b*) between the both shaft end positions, the transport drive roller 30 is difficult to deflect even if it is subjected to a pressing load from the transport driven rollers 31. Hence, it is possible to prevent the deformation of the transport drive roller 30. Further, since the bearing portions 58 are provided integrally with the platen 56 by resin molding, even if the transport drive roller 30 is anally supported at a plurality of positions, since the positions of the bearing portions are accurately fixed, the transport drive roller 30 can be driven smoothly without imparting a load thereto.

In addition, since the rotating shaft 40 of the eject drive rollers 41 is also axially supported at both shaft end positions (bearing portions 59*a* and 59*c*) and one position (bearing portion 59*b*) therebetween, it is possible to obtain an operational effect similar to the case of the transport drive roller 30 described above. Furthermore, even if backlash (clearance) has occurred between the rotating shaft 40 of the eject drive rollers 41 and each of the bearing portions 59*a* to 59*c*, since the rotating shaft 40 of the eject drive rollers 41 is axially supported at the plurality of positions, the bearing portions 59*a* to 59*c* are arranged at mutually offset positions with respect to the rotating shaft 40, it is possible to overcome the backlash.

Next, a description will be given of hole portions 64 for ejecting the ink discarded to the grooves 54 and 55 and the grooves A to G to outside (below) the lower sheet guide 50.

The hole portions 64 are formed over the entire peripheral edges of the bottoms of the grooves 54 and 55 and the grooves A to G, and openings 63 at upper portions of all the hole portions 64 are formed in such a manner as to oppose side walls of the grooves 54 and 55 and the grooves A to G. In other words, as shown in FIGS. 6 and 7, each hole portion 64 has a shape in which it extends from the bottom toward the upper portion, and a protective portion 65 is formed on the upper side of the opening of each hole portion 64. Namely, each hole portion 64 is formed in a crank shape so as not to form a channel of the fluid (air and ink) which would penetrate the platen 56 straightly upwardly from below.

The hole portions 64 which are thus formed exhibit the following operational effect. When the carriage 33 starts to move from the standstill state, there are cases where, in conjunction with that moving operation, a negative pressure is temporarily applied to the place where the cartridge 33 was at a standstill. Consequently, if there occurs the flow of air which is directed upwardly from below through the hole portions 64, an ink mist floating over the platen 56 is scattered more extensively, so that there is a possibility that the interior of the apparatus is fouled, exerting an adverse effect on the constituent elements.

However, since the protective portion 65 is provided on the upper side of the opening of each hole portion 64, as described above, the flow of air which is directed upwardly from below through the hole portion 64 abuts against the protective portion 65, and the flow is hampered, as indicated by an arrow in FIGS. 6 and 7. Namely, since the flow of air which would penetrate straightly upwardly from below through the hole portion 64 is not produced, even if the flow of air which is directed upwardly from below is produced in the hole portion 64 in conjunction with the movement of the carriage 33, since the flow is hampered, the ink mist floating over the platen 56 can be prevented from being scattered more extensively, or the extent of the scattering can be alleviated.

It should be noted that, in this embodiment, since the protective portion 65 is formed in such a manner as to substantially completely cover the opening of the hole portion 64 in a plan view of the platen 56, as shown in FIG. 5, the flow of air which is directed upwardly from below through the hole portion 64 is prevented more reliably.

The ink absorbing material 70 shown in FIG. 8 is disposed in the grooves 54 and 55 and the grooves A to G. On this ink absorbing material 70, as shown in the drawing, a plurality of projecting portions 71 are formed on its surfaces opposing the inner side walls of the respective grooves when it is disposed in the grooves 54 and 55 and the grooves A to G. Accordingly, when the ink absorbing material 70 is disposed in the grooves 54 and 55 and the grooves A to G, the ink absorbing material 70 is disposed such that its projecting portions 71 are fitted in the openings 63 (FIG. 4).

As a result, the ink absorbing material 70 is held inside the grooves 54 and 55 and the grooves A to G more reliably, so that the lifting up of the ink absorbing material 70 toward the recording head 36 side can be prevented reliably. Therefore, it becomes possible to prevent such drawbacks as the fouling of the reverse surface of the sheet P due to the lifting up of the ink absorbing material 70 and causing a decline in the recording quality due to a change in the gap between the sheet P and the recording head 36. Here, since the protective portion 65 formed on the upper side of the opening of each hole portion 64 also serves as a holding means for holding in the respective grooves the ink absorbing material 70 disposed in the grooves 54 and 55 and the grooves A to G, it becomes possible to inexpensively provide the construction for holding the ink absorbing material 70 in the respective grooves.

Figure 9:
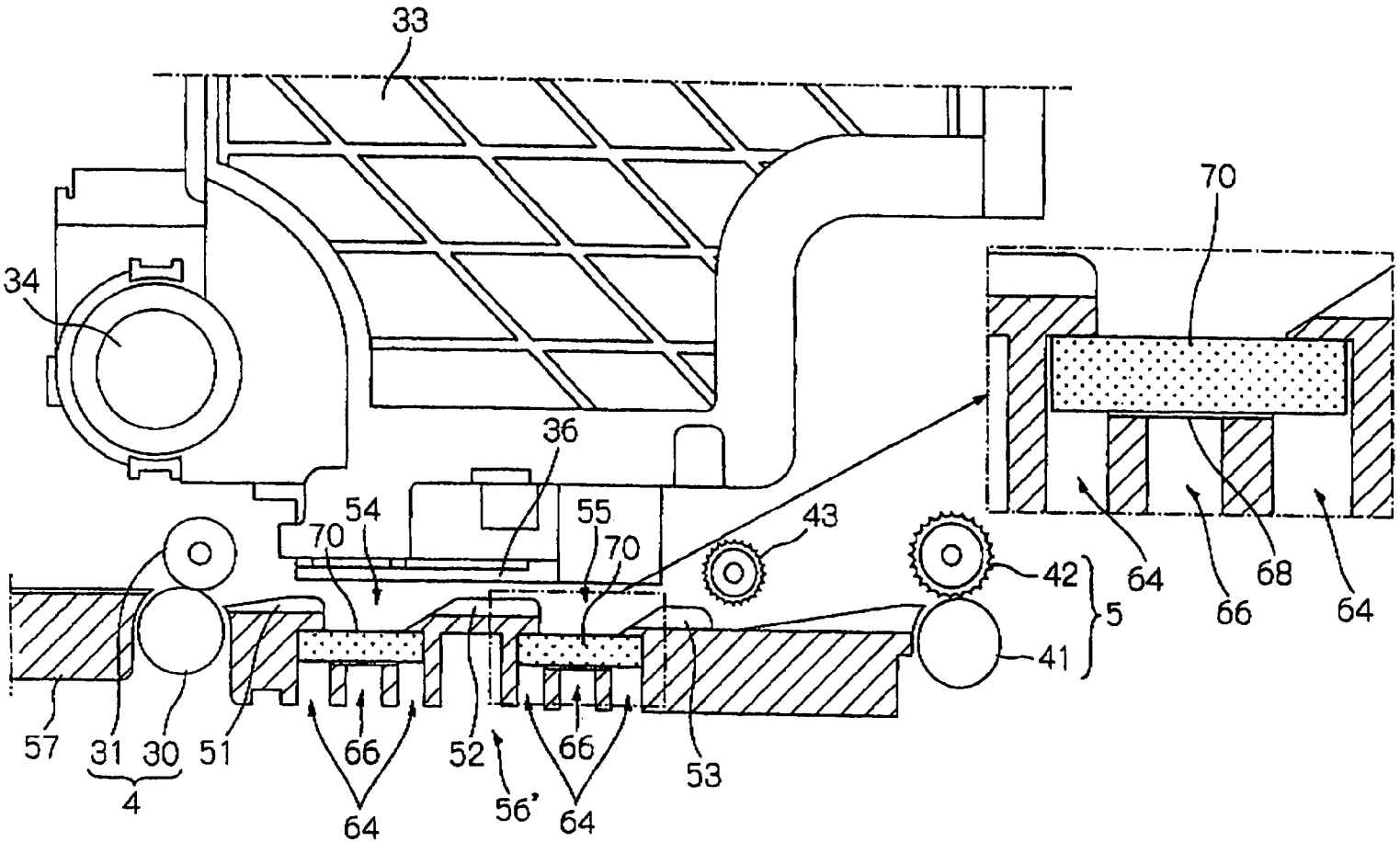
FIG. 9 is a cross-sectional view, taken along the sub scanning direction, of a platen in accordance with another embodiment.

It should be noted that there are cases where, depending on the circumstances at the time of, for instance, resin molding, hole portions 66 which would penetrate the platen 56 straightly upwardly from below are inevitably formed at the bottoms of the grooves 54 and 55 (and the grooves A to G), as shown in FIG. 9. It should be noted that FIG. 9 is a cross-sectional view, taken along the sub scanning direction, of a platen 56' in accordance with another embodiment.

In such a case, if the ink absorbing material 70 formed of a porous material is merely disposed as it is, there can occur the flow of air which would penetrate the ink absorbing material 70 upwardly from below when the cartridge 3 is moved, whereby the ink mist floating over the platen 56' is possibly scattered extensively.

Accordingly, in such a case, as a sheet material such as the one indicated by reference numeral 68 in FIG. 9 is laid in the bottoms of the grooves 54 and 55 (and the grooves A to G), it is possible to shut off the flow of air passing through the hole portions 66. Since the flow of air which would penetrate the ink absorbing material 70 upwardly from below does not occur, it is possible to prevent the scattering of the ink mist extensively.

What is claimed is:

1. A liquid ejecting apparatus comprising:

a liquid ejecting head, operable to eject liquid toward a target medium; and a liquid receiver adapted to receive the liquid ejected to a position offset from a side end of the target medium and opposing the liquid ejecting head, the liquid receiver including:

a bottom face;

a plurality of hole portions adapted to discard downwards the received liquid from the bottom face;

an opening disposed above the bottom face; and a plurality of protective portions each of which corresponds to a respective one of the hole portions, the protective portions formed at an edge of the opening overhanging so as to substantially cover the hole portions from above.

2. A liquid ejecting apparatus comprising:

a liquid ejecting head, operable to eject liquid toward a target medium; and a liquid receiver adapted to receive the liquid ejected to a position offset from a side end of the target medium and opposing the liquid ejecting head, the liquid receiver including:

a bottom face;

a plurality of hole portions adapted to discard downwards the received liquid from the bottom face;

an opening disposed above the bottom face; and a plurality of protective portions each of which corresponds to a respective one of the hole portions, the protective portions formed at an edge of the opening overhanging so as to hamper a flow of air which is directed upwardly through the hole portions.

* * * * *